US006918500B2

(12) United States Patent
Okiyama

(10) Patent No.: US 6,918,500 B2
(45) Date of Patent: Jul. 19, 2005

(54) PLUG BODY FOR MEDICAL FLUID CONTAINER

(75) Inventor: Tadashi Okiyama, Hiroshima (JP)

(73) Assignee: JMS Co., Ltd., Hiroshima (JP)

( * ) Notice: Subject to any disclaimer, the term of this patent is extended or adjusted under 35 U.S.C. 154(b) by 0 days.

(21) Appl. No.: 10/433,363

(22) PCT Filed: Nov. 28, 2001

(86) PCT No.: PCT/JP01/10413

§ 371 (c)(1),
(2), (4) Date: Jun. 3, 2003

(87) PCT Pub. No.: WO02/45648

PCT Pub. Date: Jun. 13, 2002

(65) Prior Publication Data

US 2004/0035816 A1 Feb. 26, 2004

(30) Foreign Application Priority Data

Dec. 4, 2000 (JP) ..... 2000-368273

(51) Int. Cl.[7] ..... B65D 39/00
(52) U.S. Cl. ..... 215/247; 604/411; 215/DIG. 3
(58) Field of Search ..... 215/274, DIG. 3, 215/294, 296–300, 320, 347, 349, 350, 355, 356, 363; 604/411, 415, 905, 256, 201, 206, 167; 206/363

(56) References Cited

U.S. PATENT DOCUMENTS 3,709,365 A * 1/1973 Czaplinski et al. ..... 210/233
3,760,969 A * 9/1973 Shimamoto et al. ..... 215/247
4,430,081 A * 2/1984 Timmermans ..... 604/256
4,673,393 A * 6/1987 Suzuki et al. ..... 604/167.04
5,342,316 A * 8/1994 Wallace ..... 604/167.02
5,613,663 A * 3/1997 Schmidt et al. ..... 251/149.2
5,702,019 A * 12/1997 Grimard ..... 215/301
5,853,094 A * 12/1998 Tanaka et al. ..... 215/247
6,171,287 B1 * 1/2001 Lynn et al. ..... 604/256
6,258,078 B1 * 7/2001 Thilly ..... 604/411
6,340,359 B1 * 1/2002 Silverman ..... 604/415
6,569,125 B2 * 5/2003 Jepson et al. ..... 604/201
6,699,225 B2 * 3/2004 Fujii ..... 604/256

FOREIGN PATENT DOCUMENTS

| | | |
|---|---|---|
| JP | 3-504571 | 10/1991 |
| JP | 4-253862 | 9/1992 |
| JP | 7-75663 | 3/1995 |
| WO | 90/11103 | 10/1990 |
| WO | 95/17873 | 7/1995 |

* cited by examiner

*Primary Examiner*—Lien M. Ngo
(74) *Attorney, Agent, or Firm*—Hamre, Schuimann, Mueller & Larson, P.C.

(57) ABSTRACT

A plug body for chemical container capable of preventing the contact thereof with chemical and preventing ruptured film from falling into the chemical, comprising a valve (1) having an insert hole (3) formed at the center thereof, a cover (2) for holding the valve (1) by covering at least the upper peripheral edge of the valve (1), and a locking means for locking an insert body to the cover (2) by using the edge part of the cover (2) having a fitting hole formed therein when the insert body is inserted into the insert hole (3), wherein the rear surface peripheral part of the valve (1) is held by a pedestal part (5), and a film (4) covering the rear surface of the valve is disposed on the upper surface of the pedestal part (5).

6 Claims, 13 Drawing Sheets

PLUG BODY FOR MEDICAL FLUID CONTAINER

TECHNICAL FIELD

The present invention relates to plug bodies for medical fluid containers filled with liquids. In particular, it relates to medical fluid container plug bodies that are used in conjunction with insertion bodies that have obtuse tips.

BACKGROUND ART

Generally, for anticancer drugs, antibiotics, blood products, and lyophilized preparations that are put into containers such as medical fluid bags or vials and the like, there are the problems of poor stability and reduced medicinal efficacy when these products are stored in liquid form. For these reasons, medical institutions such as hospitals have conventionally dealt with this by liquefying these preparations immediately before use, and using them in such ways as intravenous drips. The tasks required to perform this conventionally have involved filling a syringe fitted with a sharp needle with a solution or the like, then thrusting the needle into the rubber plug body of a medicine bag or similar.

Furthermore, when mixing different medical fluids from a three-way stopcock fitted in the middle of a solution-feeding line of an infusion or blood transfusion kit, or, conversely, when collecting medical fluids, or similar, while performing an infusion or blood transfusion for a patient, there are always the tasks of detaching and attaching needles to the main body of the syringe, and using sharp needles for this is accompanied with the risks of accidental needle jabs and medical fluid contamination.

Moreover, synthetic rubbers such as isoprene rubber are used for almost all the plug bodies for these medical fluids, and contact between these and the medical fluids can cause problems of medical fluid contamination due to the elution of additives, so that contact between the plug and the medical fluid is currently avoided by providing a plastic film between these plug bodies and medical fluids. Further, conceivable methods for providing these plastic films include, for example, methods in which fluorine-based resins or the like are laminated on the surface that comes in contact with the medical fluid.

Various contrivances are used in ways intended to solve these problems, such as using adapters or communicating devices such as linking tubes to connect syringes fitted with obtuse cannulas to vials or the like, and then infusing or drawing out the medical fluids.

For example, PCT (WO) H3-504571 (1991) discloses mainly a slitted infusion area into which an obtuse cannula can be inserted repeatedly.

Furthermore, JP H7-75663A (1995) discloses mainly a method of preventing medical fluid contact by applying film to a slitted plug body. Further, at the opening of the container, a rubber plug body is used that is provided with a pre-perforated penetration hole, with this penetration hole enabling approximately 1-mm diameter metal needles to pass through the rubber plug body, and being small enough not to be easily distinguished from the surface by the naked eye. When not yet punctured by a cannula, the plug stays in a blocking condition due to self-sealing of the rubber, and when punctured by a cannula, the surface of the punctured hole adheres to the outer periphery of the cannula due to self-sealing of the rubber.

However, in the method disclosed in PCT (WO) 3-504571 (1991), a special-purpose cannula is necessary in order to allow insertion through the sealing materials. Further, there is no mention of the possibility of using ordinary syringes. Therefore, for infusion or blood transfusion kits requiring three-way mixed injection openings, there exists the potential problem of being unable to perform mixing injections.

Moreover, as no measures are implemented in regard to medical fluid contact, the issue of avoiding contact between the plug body and the medical fluids is unresolved.

On the other hand, JP H7-75663A (1995) has the problem that, although suitable for the insertion of needles with comparatively sharp ends, it is unsuitable for insertion bodies with a flat-surface end such as a syringe luer connector. This is because a large penetration resistance is required to pass through the film at the time of insertion.

Furthermore, there is also the problem that, although the pore surface can adhere to the outer periphery of the cannula due to the self-adhesiveness of the rubber, it is difficult to ensure that inserted cannulas can be maintained stably without wobbling movements.

Moreover, there is no consistency in the way the film ruptures when insertion bodies are inserted, which entails the risk, depending on the way it ruptures, of pieces of ruptured film falling into the medical fluids and causing contamination of the medical fluids.

It is an object of the present invention to solve the problems above by providing a plug body for a medical fluid container, with which contact between plugs and medical fluids can be prevented, and that can be used with insertion bodies with obtuse tips.

DISCLOSURE OF INVENTION

In order to achieve the objective stated above, a plug body for a medical fluid container of the present invention includes a disk-shaped valve provided with an insertion hole in its central portion; and a cover that fixedly supports the valve, covering at least the valve's upper periphery; wherein a lower periphery of the valve's rear surface is supported by a pedestal portion, a film covering the rear surface of the valve is arranged on an upper surface of the pedestal portion, and the film can be pressed through by an insertion member with an obtuse tip; and wherein a front surface of the valve has a ring-shaped notch portion, which, upon insertion of the insertion member with an obtuse tip, causes the valve to be sectioned into a portion that is fixed and a portion that expands.

With this structure, in addition to being able to securely fasten the valve between the cover and the pedestal portion, it is possible to prevent contact between the valve and the medical fluids, and it is possible for the film to be passed through with low penetration resistance, even when using insertion bodies with obtuse tips, of which syringe luer connectors are typical.

Furthermore, it is preferable for the plug body for medical fluid containers of the present invention to have a locking means to lock an insertion member to the plug body using the outer edge of the cover, which is provided with a fitting hole for when an insertion member is inserted into the insertion hole. In addition to allowing easy and reliable interlocking for insertion bodies with obtuse tips, of which syringe luer connectors are typical, this also can prevent contact between the plug body and medical fluids.

Furthermore, it is preferable for the outer portion of the upper surface of the pedestal portion of the plug body for medical fluid containers of the present invention to be beveled. As this reduces the pressure asserted on the border between the heat-sealed areas of the film and the other areas, due to obtuse angle contact with the pedestal portion when an insertion member is inserted, this reduces the likelihood of pieces of film tearing away from the border area and falling as fragments of ruptured film.

Furthermore, for the plug body for medical fluid containers of the present invention, it is preferable for the penetration resistance for when an insertion member with an obtuse tip is thrust into the film to be no more than 30 Newtons. This is because this enables the film to be easily broken by pressure applied to it by the obtuse tip of an insertion member, of which syringe luer connectors are typical.

Furthermore, for the film of the plug body for medical fluid containers of the present invention, it is preferable for this to be a layered film including a film provided with a multitude of pass-through pores and film with no microholes. Also, for the film of the plug body for medical fluid containers of the present invention, it is also suitable for this to be a film provided with a multitude of non-pass-through pores. Further, it also could be a film provided with slits that do not pass through the film. Those enable easy rupturing of the film, even for insertion bodies with obtuse tips such as luer connectors.

Furthermore, it is preferable for the film of the plug body for medical fluid containers of the present invention to tear linearly when torn by an insertion member. This makes it difficult for pieces of film to tear away and fall from the pedestal portion.

BEST MODE FOR CARRYING OUT THE INVENTION

Embodiments of the present invention are explained in the following, referring to the accompanying drawings.

First, a plug body for medical fluid containers according to an embodiment of the present invention mainly includes a valve to open and close the flow channel, a cover to fixedly support that valve, a means for locking an insertion member such as a syringe luer connector, provided in the cover, and a film to cover the rear side of the valve. These structural elements are explained below.

Figure 1:
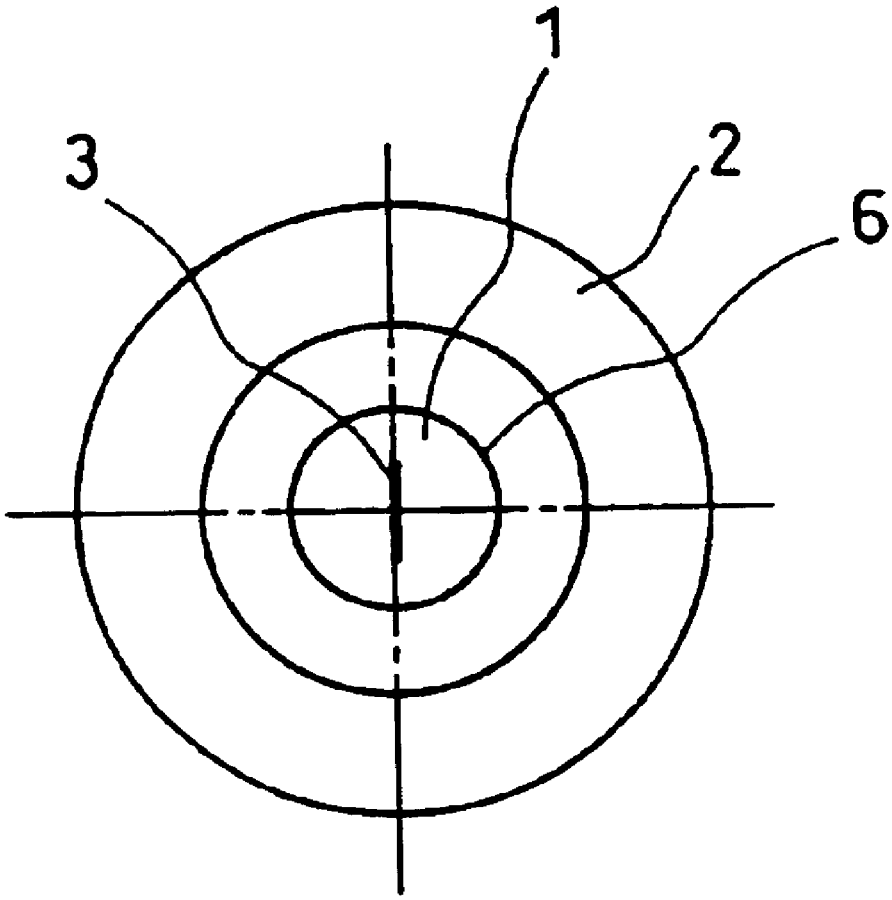
FIG. 1 is a top plan view of the plug body for medical fluid containers of the present invention.
Figure 2:
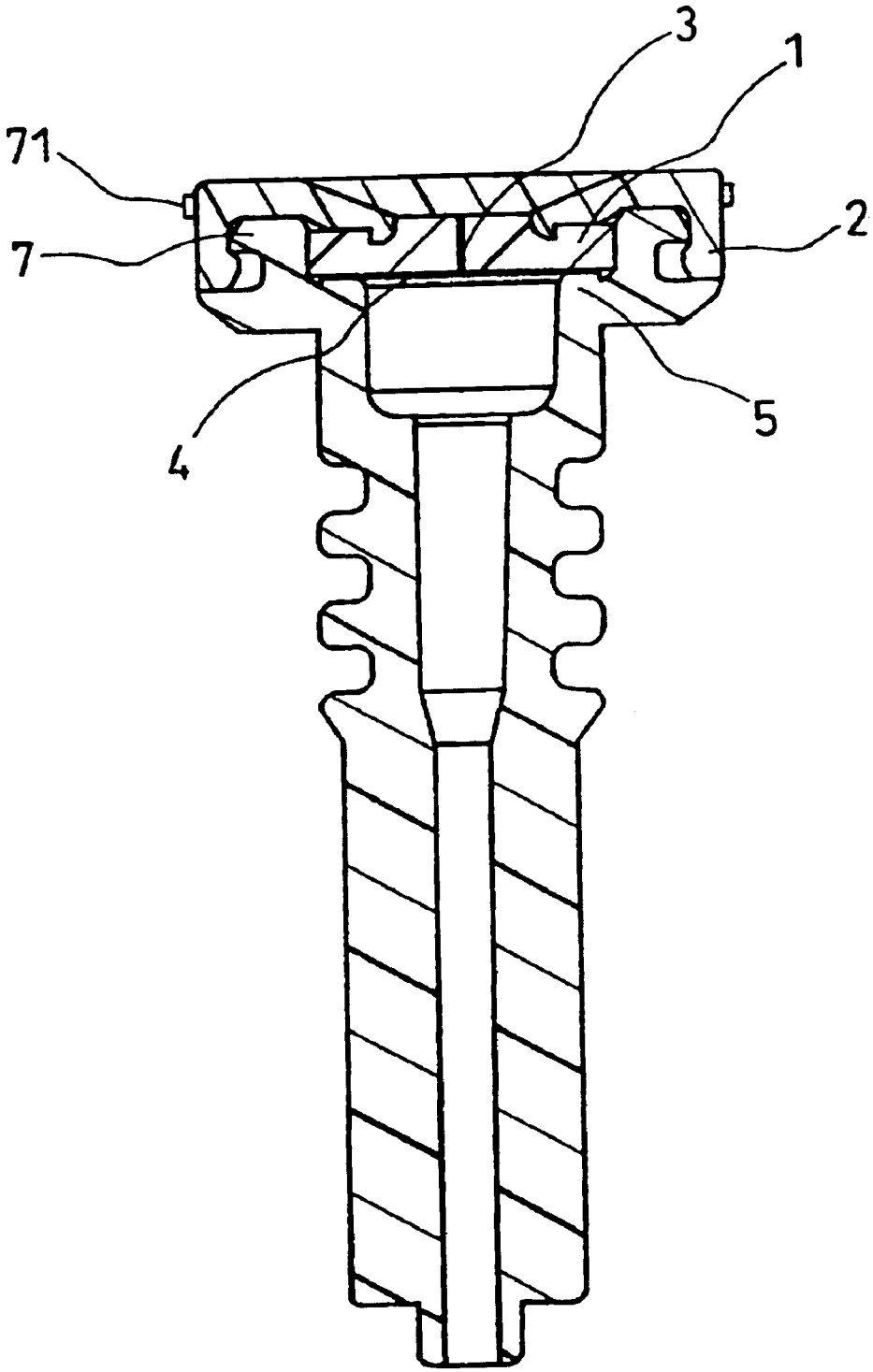
FIG. 2 is a cross sectional view of the plug body for medical fluid containers of the present invention.

As long as the cover is sturdy enough to hold (fixedly support) the valve when the insertion member is inserted into or extracted from the valve, there is no particular limitation to it. For example, as shown in FIG. 1 and FIG. 2, if a cover 2 is provided so that the center area of the front surface of a valve 1 is left open (exposed) and is at least covering the upper periphery of the valve 1, it will be easier to find the insertion position for the insertion member, and contamination of the valve surface due to accidental contact can be prevented. Better effectiveness can also be achieved by providing a gentle taper (slant) to the front side of the cover 2.

There is no particular limitation to the outward form of the aperture portion of the plug bodies for medical fluid containers according to embodiments of the present invention, as long as the valve 1 can be supported fixedly by covering it with the cover 2. However, in order that valve 1 can be firmly fastened in its prescribed position in the event of insertion of an insertion member, it is preferable that there is a pedestal portion 5 to support the lower periphery of the valve 1 while leaving open the center area of the rear surface of the valve 1.

The locking means is not required to have a particular limitation, as long as it has a simple structure and locks the insertion member (such as a syringe luer connector) at the plug body for medical fluid containers. For example, it may be the circular fitting hole formed at the center of the cover 2, provided with shape and dimensions that enable lockable fitting of the fitting hole and an insertion member such as a luer connector. With such a structure, the insertion member can be reliably locked by a simple structure.

Figure 3A:
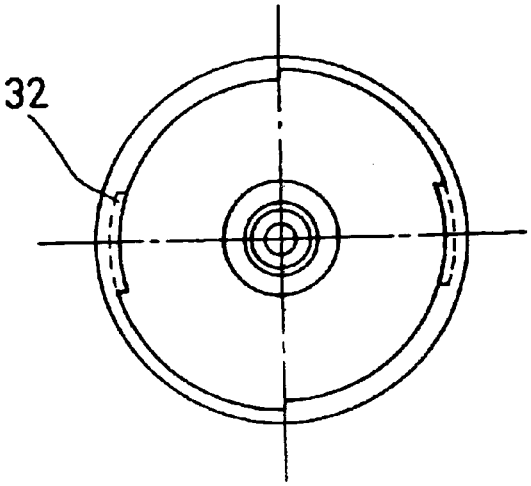
FIG. 3A is a bottom view of the lock adapter.
Figure 3C:
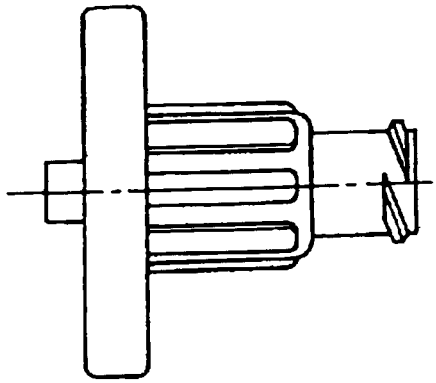
FIG. 3C is a side view of the lock adapter of the plug body for medical fluid containers of the present invention.
Figure 3B:
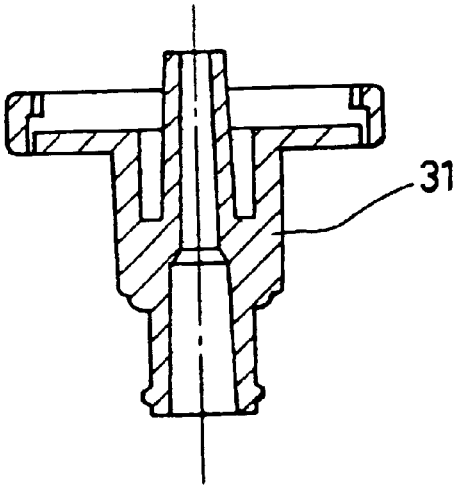
FIG. 3B is a side cross-sectional view of the lock adapter of the plug body for medical fluid containers of the present invention.

Furthermore, in order to perform even more reliable locking for the insertion member, it is effective to use a lock adapter as shown in FIG. 3. In FIG. 3, FIG. 3A shows a bottom view of the lock adapter, FIG. 3B shows a side cross-sectional view of the lock adapter, and FIG. 3C, shows a side view of lock adapter.

As shown in FIG. 3, the lock adapter uses a notch portion 32 installed in the lower part of the lock adapter cap cover 31 to fasten the cover 2.

Figure 4:
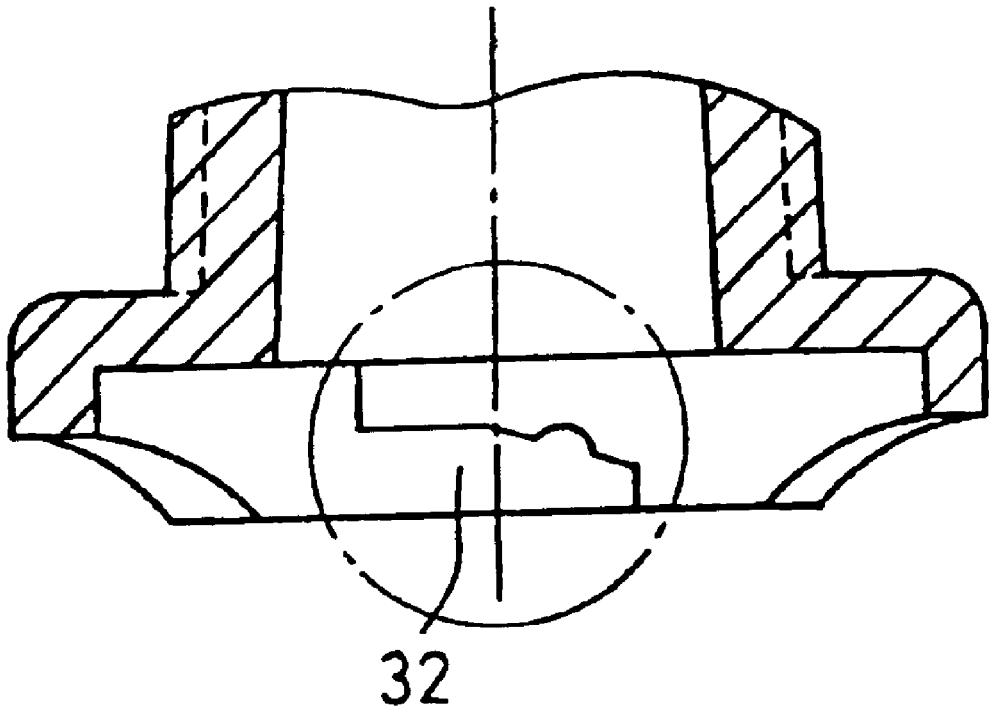
FIG. 4 is an enlarged cross-sectional view of the lower part of the lock adapter of the plug body for medical fluid containers of the present invention.
Figure 5A:
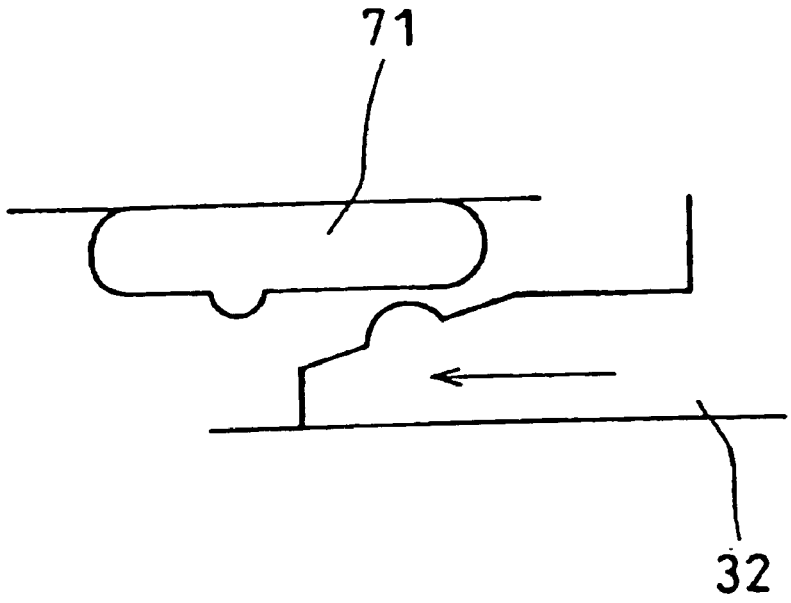
FIG. 5A shows the condition immediately before connection of the lock adapter cover.
Figure 5B:
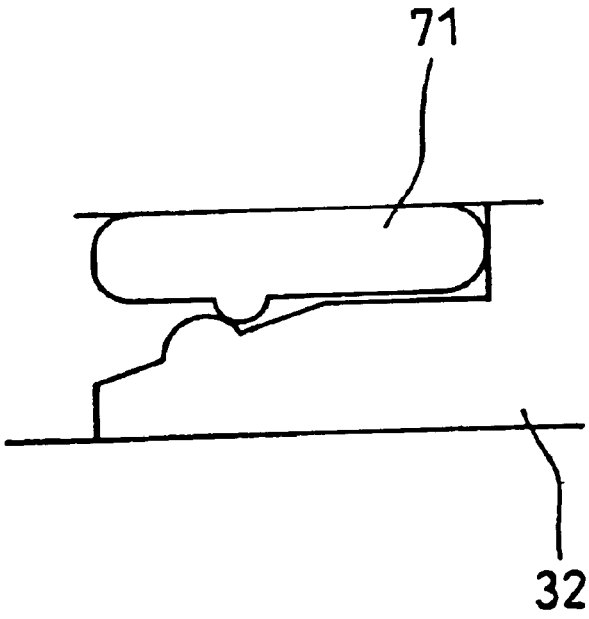
FIG. 5B shows the condition immediately after connection of the lock adapter cover.

More specifically, FIG. 4 shows an enlarged cross-sectional view of the lower part of a lock adapter cap cover 31, in which the notch portion 32 for rotational engagement is provided on the inner side of the lock adapter cap cover 31. The lock adapter cap cover 31 is inserted as shown in FIG. 5A, so that the notch portion 32 fits with a protrusion 71, which is provided at the outer edge of the cover 2, and enables reliable fastening by locking with further rotation as shown in FIG. 5B.

Furthermore, if the insertion member is a syringe end possessing a general luer connector shape, it is preferable for the dimensions of the fitting hole 6 in the cover 2 to have a diameter of 3.9 to 4.4 mm, and the edge portion of the cover 2 that is provided with the fitting hole 6 to have a wall thickness of 0.3 to 2.0 mm. Also, it is preferable that the cover 2 has strength sufficient for it not to break even when the insertion member is fitted firmly into the fitting hole 6. In consideration of such factors as medical fluid resistance and heat resistance, possible materials for this include polyacetal, polypropylene, polyethylene, polyamide, polyethylene terephthalate, polybutylene terephthalate and polycarbonate.

The valve 1 should afford easy insertion and withdrawal of the insertion member, and reliable opening. For example, it is conceivable that the shape of the surface of the disk-shaped valve 1 is a flat shape. Also, by giving the disk-shaped valve 1 a bowl shape, the insertion member can be inserted more easily, as well as making inadvertent withdrawal more difficult. This also has the advantage of suppressing liquid leakage from the insertion hole when the insertion member is withdrawn. However, there are practical drawbacks in that residual liquids can collect on the disk-shaped valve 1, and that such residual liquids are difficult to clear away.

Furthermore, the outward form of the valve 1 being circular, or elliptical, is convenient for forming the opening portion of the container. It is convenient if the insertion hole 3 of the valve 1 is a linear slit. The material for constructing the valve 1 should be a material with a rubber-like elasticity, or to further limit this, a material with a JIS-A hardness of 20 to 55 is preferable. Specific possible materials include silicone rubber, natural rubber, or synthetic rubbers such as butyl rubber and nitrile rubber, or thermoplastic elastomer and similar materials.

Furthermore, in order to prevent contact between the valve and medical fluids, the plug bodies for medical fluid containers according to embodiments of the present invention are provided with a film 4 at any location from the rear surface of the valve to the position that can be pierced by the insertion member. If the material of the valve is selected from the group of materials consisting of vulcanized rubbers such as silicone rubber, natural rubber, and synthetic rubbers, as well as thermoplastic elastomer, there exists the risk of additives being eluted out by contact between the rear surface of the valve and the medical fluids inside the container when medical fluids are stored, and this elution can be prevented by the film 4.

Moreover, as for the material of the film 4, there are no particular restrictions as long as it is a film capable of being pressed through by an insertion member with an obtuse tip, but it is preferable for it to have a penetration resistance of a range not more than 30 Newtons. This is because it enables the film to be broken easily by pressure applied to it by the obtuse tip of the insertion member, for which syringe luer connectors are a typical example.

Specific examples include polypropylene-based films degraded by gamma radiation; layered plastic films whose layers have different laser absorption, wherein portions of their resin layers have been laser processed to provide slits that do not pass through all the way; and layered films of a film provided with pores that pass through all the way and a film (heat sealed layer) that maintains fluid tightness and does not have pores.

Furthermore, it is necessary that this film 4 does not result in pieces of ruptured film dropping when the insertion member is inserted, and possesses the mechanical property that it can be ruptured easily. This is in order to prevent contamination of the medical fluid by fallen pieces of ruptured film.

Referring to the accompanying drawings, the following is an explanation of a plug body for medical fluid containers according to an embodiment of the present invention. FIG. 1 is a top plan view of the medical fluid container plug body according to an embodiment of the present invention, and FIG. 2 is a cross-sectional view of the medical fluid container plug body according to an embodiment of the present invention. In FIG. 1 and FIG. 2, numeral 1 indicates the disk-shaped valve, numeral 2 the cover, and numeral 3 the insertion hole.

Figure 6A:
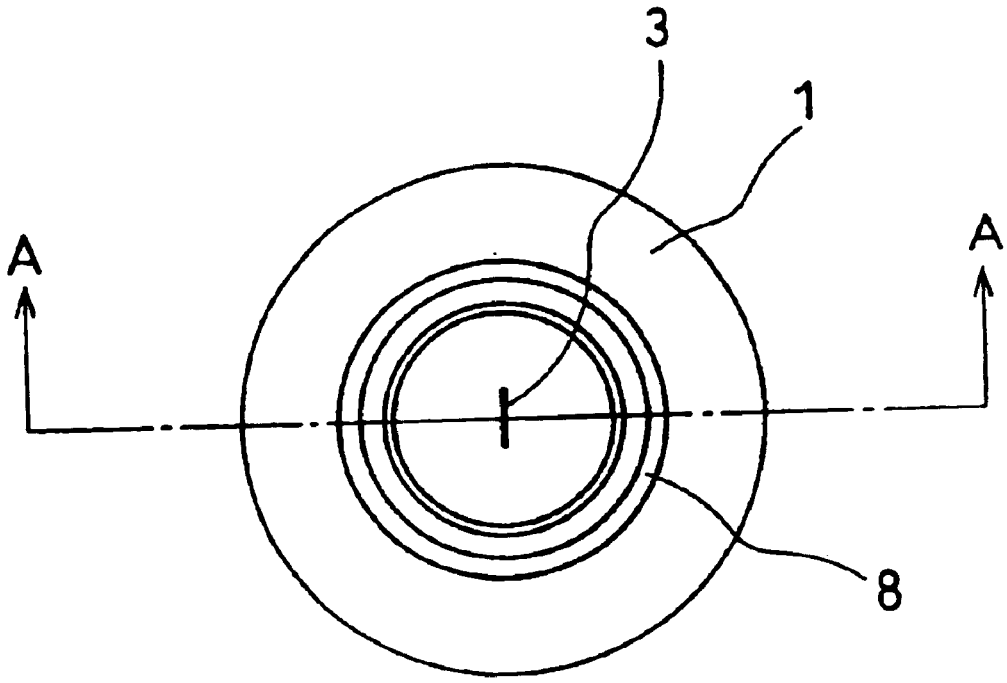
FIG. 6A is a top plan view of the valve for the medical fluid container plug body for the present invention.
Figure 6B:
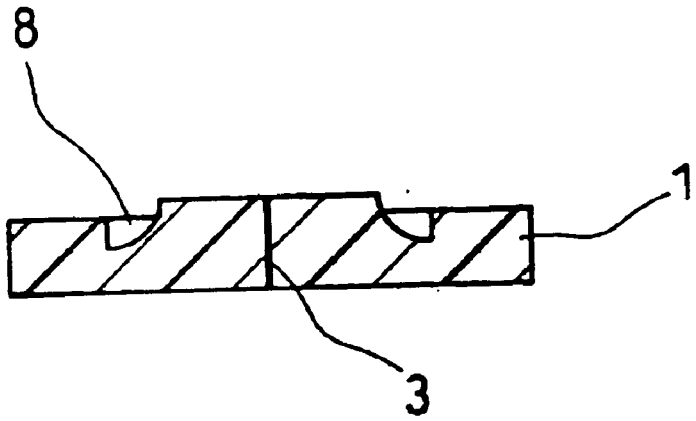
FIG. 6B is a cross-sectional view of the valve for the medical fluid container plug body for the present invention.

FIG. 6A is a top plan view of the valve 1 of the medical fluid container plug body according to an embodiment of the present invention, and FIG. 6B is a cross-sectional view of the valve 1 of the medical fluid container plug body according to an embodiment of the present invention. As shown in FIG. 6A and FIG. 6B, in addition to a ring-shaped notch 8 on its top surface, the disk-shaped valve 1 possesses a shape in which its thickness near the center is greater than its thickness at peripheral areas. By doing so, it is possible to eliminate the difference in level of the edge portion of the cover 2 that is provided with the fitting hole 6, and it becomes easier for medical fluids to be cleared away, etc.

Also, because the cover 2 and the pedestal portion 5 are fastening the disk-shaped valve 1, the valve 1 is sectioned into a portion that is compressed and a portion that is stretched by the insertion of an insertion member such as a luer connector. Moreover, with the ring-shaped notch 8 present as a starting portion on the surface of the disk-shaped valve 1, the disk-shaped valve 1 stretches more easily. That is, when an insertion member is inserted in the disk-shaped valve 1, the portion of the disk-shaped valve 1 that is located further inward than the portion supported by the pedestal portion 5 is stretched, but the outer portion maintains its prescribed position.

Further, in this embodiment, the insertion hole 3 is in the form of a single linear slit, but there is no particular limitation in this regard. For example, it may also be a slit form made of three intersecting linear slits.

Furthermore, as shown in FIG. 2, it is preferable that a pedestal protruding portion 7 is present around the pedestal portion 5. Liquid leakage between the cover 2 and the pedestal portion 5 can be prevented by the cover 2 and the pedestal portion 5 fastening the disk-shaped valve 1. However, if the film 4 is welded to the top surface of the pedestal portion 5 by heat sealing, unevenness in the height of the pedestal portion 5 results. Even in these circumstances, if the pedestal protruding portion 7 is provided in a position contacting the periphery of the disk-shaped valve 1, leakage between the pedestal protruding portion 7 and the disk-shaped valve 1 can be prevented.

Figure 7A:
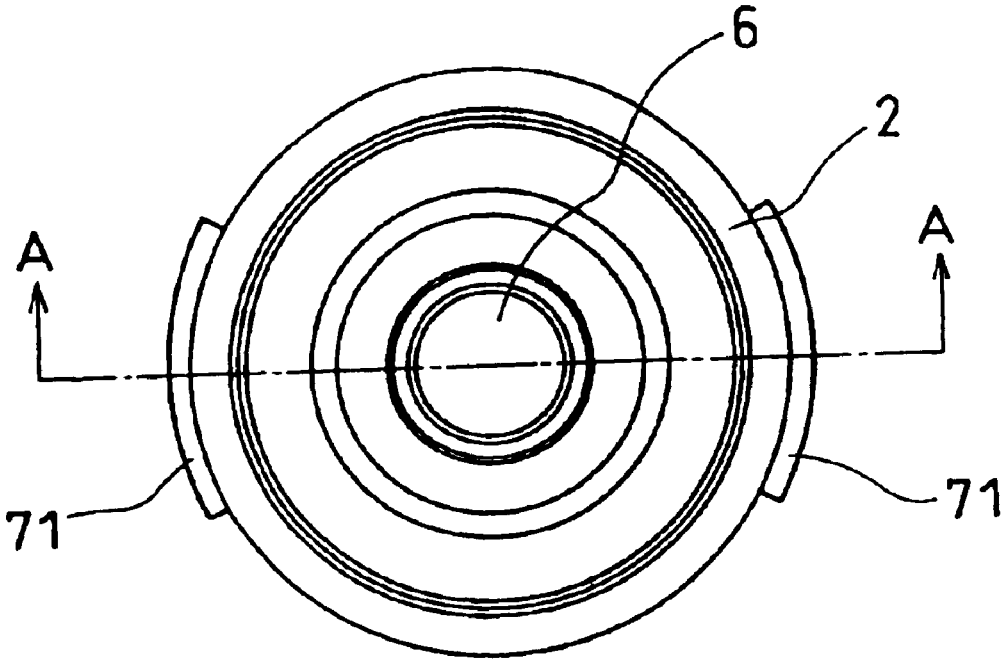
FIG. 7A is a bottom view of the cover for the medical fluid container plug body for the present invention.
Figure 7B:
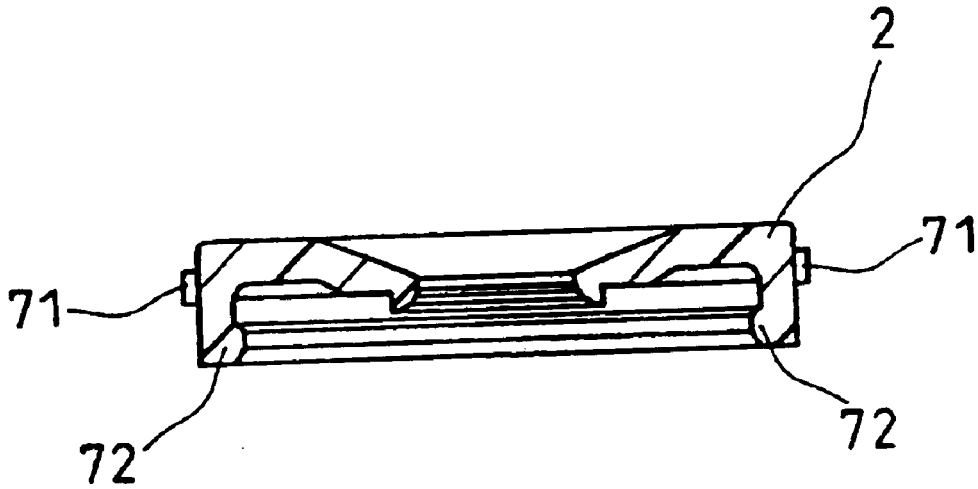
FIG. 7B is a cross-sectional view of the cover for the medical fluid container plug body for the present invention.

Furthermore, FIG. 7B shows a cross-sectional view of the cover 2 of the medical fluid container plug body according to an embodiment of the present invention, and FIG. 7A shows a bottom view of the cover 2 of the medical fluid container plug body according to an embodiment of the present invention.

As shown in FIG. 7A, at its center, the cover 2 has a fitting hole 6, and, as shown in FIG. 7B, a gentle taper (slant) faces toward the fitting hole 6. Also, as shown in FIG. 7A, in order for the cover 2 to be able to easily fasten the plug body, a ring-shaped cover protruding portion 72 is present at the lower edge of the peripheral portion of the cover 2, and, as shown in FIG. 2, is engaged with the pedestal protruding portion 7, which is present at the periphery of the pedestal portion 5 of the plug body.

Figure 13:
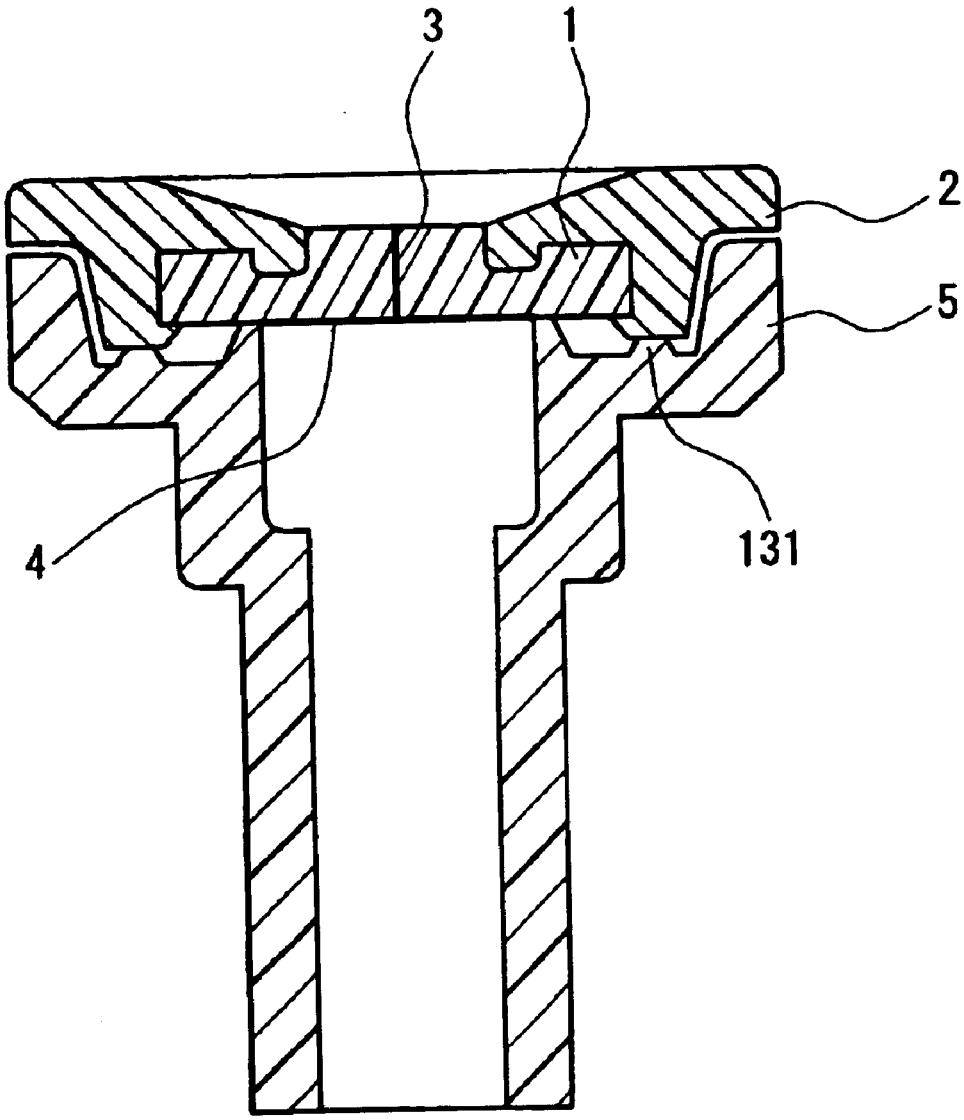
FIG. 13 is an explanatory diagram of a method for welding a cover and a pedestal portion in regard to the medical fluid container plug body for the present invention.

Also, it is conceivable that the cover 2 and the pedestal portion 5 are fixed together by ultrasonic welding. In this case, as shown in FIG. 13, the cover protruding portion 72 and the pedestal protruding portion 7 do not exist, and an ultrasonic-weld rib 131 is provided in a ring around the upper surface of the pedestal portion 5. Additionally, by welding the ultrasonic-weld rib 131 with ultrasonic waves, the cover 2 and the pedestal portion 5 are welded.

Further, in this embodiment, the periphery of the cover 2 is shown as circular, but it could also suitably be elliptical as the form of the valve, or it could be polygonal.

By letting the cover 2 expose the center of the disk-shaped valve 1 and cover the upper periphery of disk-shaped valve 1, as well as fixedly support it, it is possible to reduce the externally exposed surface area of the aperture portion of the plug body for medical fluid containers, and it is also possible to greatly decrease the opportunities for such events as ingress of impurities to the medical fluid inside the container and infection by bacteria suspended in the air.

As for the material for cover 2, it is necessary for it to have an appropriate hardness in order to firmly hold the disk-shaped valve 1 and the insertion member. In particular, in order for the cover 2 to facilitate the insertion of the insertion member into the fitting hole 6 (if too hard, tolerance is reduced for insertion of insertion bodies) and enable firm fittings, it is preferable that the cover 2 has an appropriate hardness and is made of a material that is difficult to break. For example, materials such as polyacetal, polypropylene, and polyethylene, as well as polyamide, polyethylene terephthalate, polybutylene terephthalate, and polycarbonate are preferable.

As for the materials that constitute the valve 1, these should be materials that exhibit ordinary rubber elasticity, or to further limit this, a material with a JIS-A hardness of 20 to 55 is preferable. Specific possible materials include silicone rubber, natural rubber, or synthetic rubbers such as butyl rubber and nitrile rubber, or thermoplastic elastomer and similar materials.

Furthermore, it is preferable that the wall thickness in the vicinity of the disk-shaped valve 1 and the insertion hole 3 is 1.0 mm to 3.2 mm. This enables a reduction of liquid leakage, and the insertion member can be inserted easily.

Furthermore, as for the materials for the film 4, even for insertion bodies with obtuse tips such luer connectors, it is necessary that the material be able to be ruptured easily by the insertion of such insertion bodies. It is preferable that the film 4 has a penetration resistance of not more than 30 Newtons. If it is 30 Newtons or less, the film can be easily broken by inserting an insertion member with an obtuse tip, for which syringe luer connectors are a typical example. Additionally, it is necessary for the surface of the film 4 that comes in contact with the medical fluid to have medical fluid resistivity.

Figures 8A, 8B:
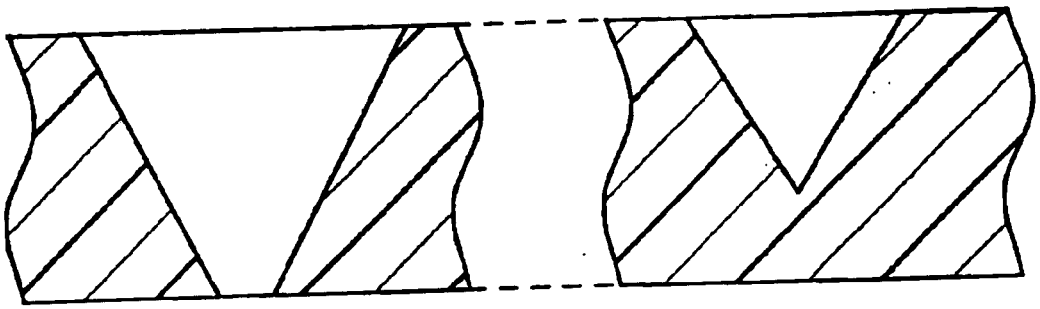
FIGS. 8A to 8C are explanatory diagrams of the film for the medical fluid container plug body for the present invention.
Figure 8C:
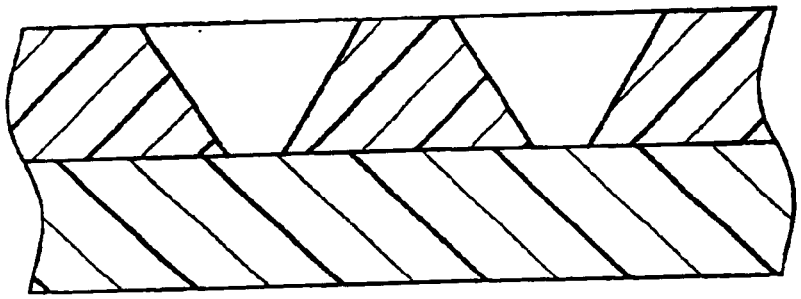

As for films that have such penetration resistance values, it is preferable to use films, as shown in FIG. 8B, that are provided with a multitude of non-pass-through pores. Also, as shown in FIG. 8C, the film may also be a layered film, having at least a film with a multitude of pass-through pores and a film with no pass-through pores.

As for the materials of films provided with a multitude of pores, materials such as polyethylene terephthalate, polyethylene, polycarbonate, polyvinylidene chloride, and polypropylene are possible, but films that have medical fluid resistance, heat resistance, and moisture resistance, such as polyethylene terephthalate and polypropylene, are preferable.

Furthermore, as for the methods for providing films with a multitude of pores, methods of forming pores by laser beam irradiation, methods in which, once the film is brought to its softening point, heated pins pierce the film and open holes by fusion, or methods in which heat and pressure are applied to the film by embossing rollers to open holes are conceivable.

The film without pores (heat sealed layers), is made of at least one layer of a synthetic resin sheet that has the function of maintaining a state of being non-permeable by liquids. Also, it should have heat sealability in order to undergo heat fusion with the pedestal portion 5.

As for the material of the film without pores, polyethylene, alpha-ethylene-acrylic acid copolymers, alpha-ethylene-methacrylic acid copolymers, ionomers, and ethylene-vinyl acetates copolymers are conceivable. In particular alpha-ethylene acrylic acid copolymers and alpha-ethylene-methacrylic acid copolymers are preferable for their high adhesive strength. High adhesive strength enables rupturing to be propagated quickly.

As for examples of structures of the layered film that is structured from film provided with a multitude of pores and film (heat sealed layer) without pores, combinations such as stretched polypropylene that has undergone processing for pores with non-stretched polypropylene, as well as combinations such as polyethylene terephthalate that has undergone processing for pores with non-stretched polypropylene, are conceivable.

An example of a particularly preferable structure is the combination of a molecularly orientated polyethylene terephthalate that has undergone processing for pores with non-stretched polypropylene. Because the layer of film that has undergone processing for pores possesses the quality that fissures are propagated in one direction (linear rupturing), the possibility of ruptured film tearing off from the heat sealed portion to fall into the medical fluid and thereby contaminate it is reduced.

Furthermore, films that are made of polymer blends adjusted to the desired penetration resistance, such as cyclic polyolefin mixed with materials such as polypropylene or polyethylene, are also suitable. In this case, blends of cyclic polyolefin mixed with polypropylene or polyethylene in a mixing ratio of around 2:8 are preferable.

Plastic films have been enumerated above as specific examples of the film 4, but there is no particular limitation to these films. For example, although inferior in terms of disposability, a layered film in which one layer is aluminum foil that is easily ruptured, combined with a heat sealed layer, also would be suitable.

With this configuration, the films can be ruptured easily by the pressure of obtusely pointed objects such as luer connectors. Further, films provided with a multitude of pass-through pores, as that shown in FIG. 8A, are inappropriate because they still involve the risk of contact between the rear surface of the valve and the medical fluids.

Figure 9:
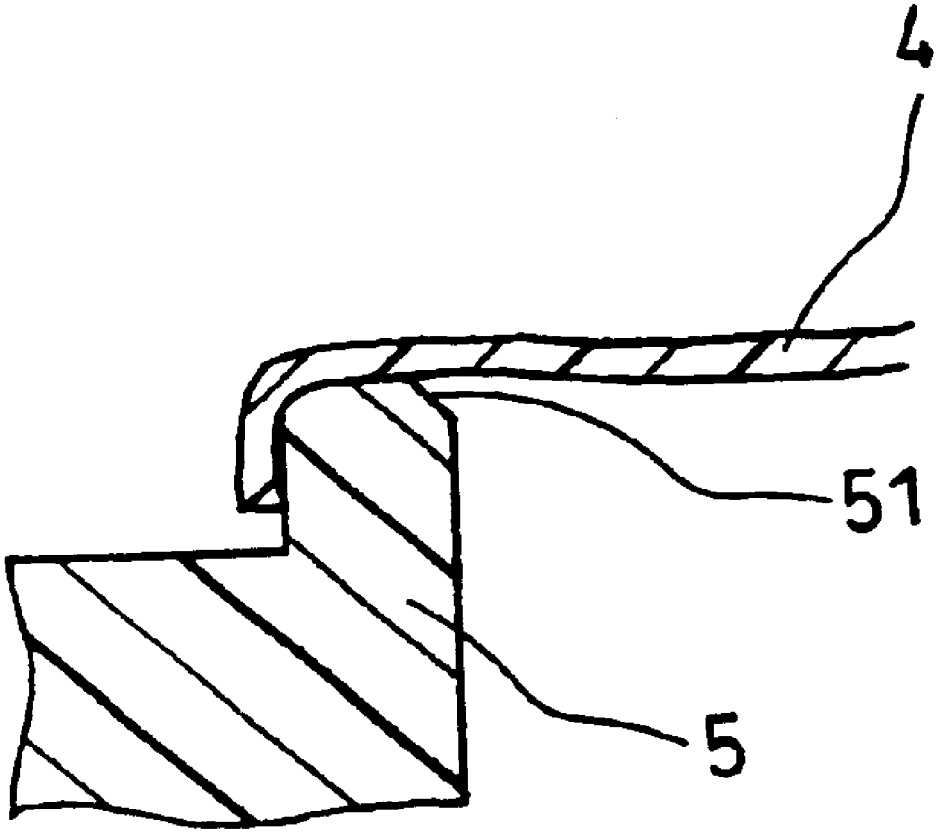
FIG. 9 is a cross-sectional view of the pedestal portion for the medical fluid container plug body for the present invention.

Furthermore, as the film is welded only by heat sealing to the top surface of the pedestal portion, depending on how the film ruptures, there is the risk of the medical fluid becoming contaminated by the ruptured pieces of film falling into the medical fluid. Therefore, to prevent welded film from falling easily, it is possible, as shown in FIG. 9, to perform beveling 51 or the like for the inner periphery of the upper surface of the pedestal portion 5. By doing this, it is possible to eliminate the sharp angle between the film 4 and the pedestal portion 5 with respect to when direct pressure is applied on the inner periphery of the upper surface of the pedestal portion 5 by insertion of the insertion member, and this can be expected to very reliably prevent the falling of welded film.

Figure 10:
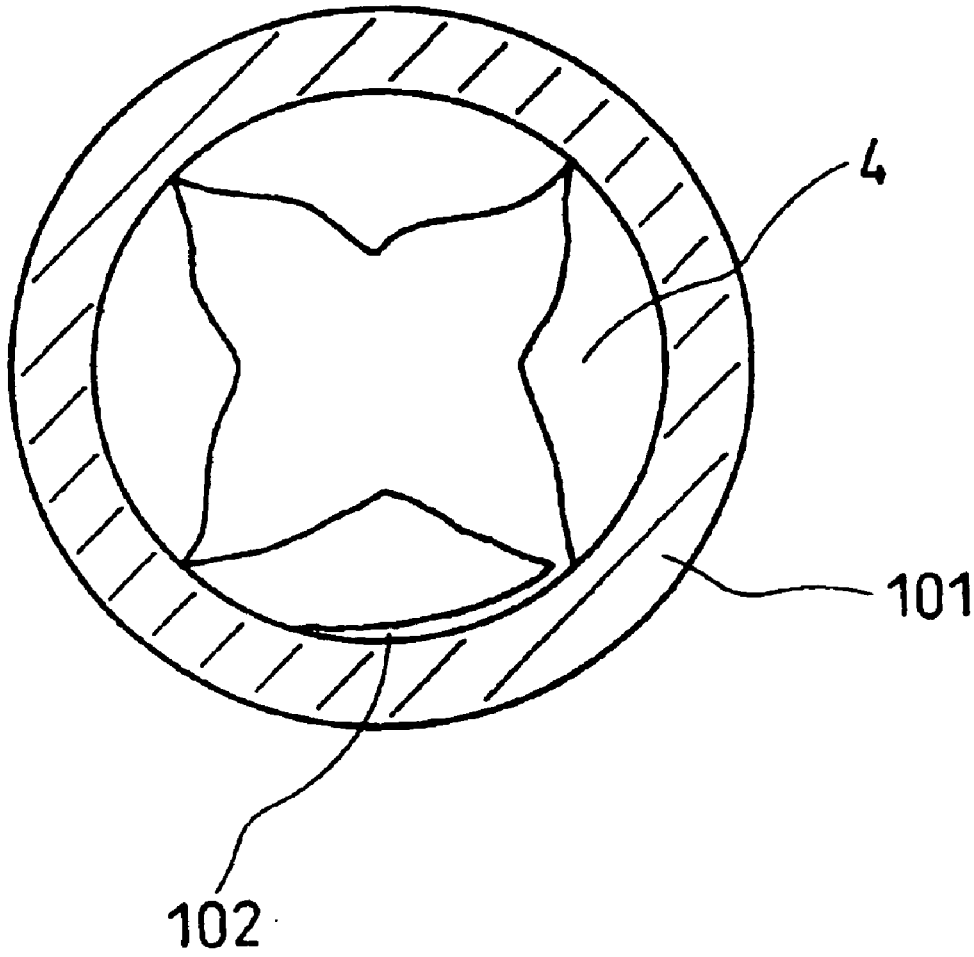
FIG. 10 is an explanatory diagram of film rupture for the medical fluid container plug body for the present invention.

Additionally, for example as shown in FIG. 10, in the event of the film 4 tearing in a cross shape, it can be seen that some portion of the ruptured areas will tear away from heat sealed part 101 and form torn part 102, thus resulting in it being easier for such portions to fall into the medical fluid. Therefore, to reduce the possibility of this even a little, it is desirable that the film 4 is formed as far as possible in a way that results in almost straight-line tearing. This is because being torn in straight line reduces the likelihood of parts of heat sealed part 101 being torn away and forming a torn part 102.

For this reason, by providing, for example, areas on the inner periphery of the upper surface of the pedestal portion 5 that are beveled, and areas that are not beveled, thereby providing areas in which the film 4 and the pedestal portion 5 meet at a sharp angle and areas in which they meet at an obtuse angle, it is thus possible to control the way in which the film 4 tears in the event of insertion of an insertion member.

The following is a more specific explanation of examples of embodiments of a plug body for medical fluid containers in accordance with the present invention.

First, polypropylene was used to produce a pedestal portion 5 provided with a structure as that shown in FIG. 2, and then, for the film for the pedestal portion 5, two types of mixed films were heat-welded, (1) a combination of polyethylene terephthalate that had undergone processing for pores and non-stretched polypropylene, and (2) a combination of aligned-pore polyethylene terephthalate and non-stretched polypropylene. Each had 1,500 to 2,000 pores per square-centimeter.

Then, after welding, a disk-shaped valve 1 made of isoprene rubber was fastened between a cover 2 made of polypropylene and the pedestal portion 5 and high-pressure steam sterilization was performed for 30 minutes at 115° C. The following two experiments were performed for these plug bodies for medical fluid containers.

First, for experiment 1, a force gauge (a "Push Pull Scale" with a full scale of 98 Newtons manufactured by Komura Seisakusho Co., Ltd) was used to measure the maximum load (penetration resistance) of an ordinary syringe luer connector being thrust into the film 4 of the plug bodies for medical fluid containers, and both measured 24.5 Newtons. On the other hand, the maximum load (penetration resistance) when a plastic (polycarbonate-made) needle was thrust into a rubber plug body that does not have pass-through holes was 30 Newtons, therefore it was evident that for insertion bodies with obtuse tips, such as luer connections, penetration could be achieved with a lower penetration resistance than that of conventional plug bodies.

Next (in experiment 2), we measured the number of occurrences of foreign matter when an ordinary syringe luer connector was thrust into the film 4 of the plug bodies for medical fluid containers. In the experiment, for foreign matter that is undetectable by the human eye, we used a light-shielded type automatic particulate measurement apparatus, and for foreign matter that is detectable by the human eye, we used a capture method based on membrane filtering.

Figure 11:
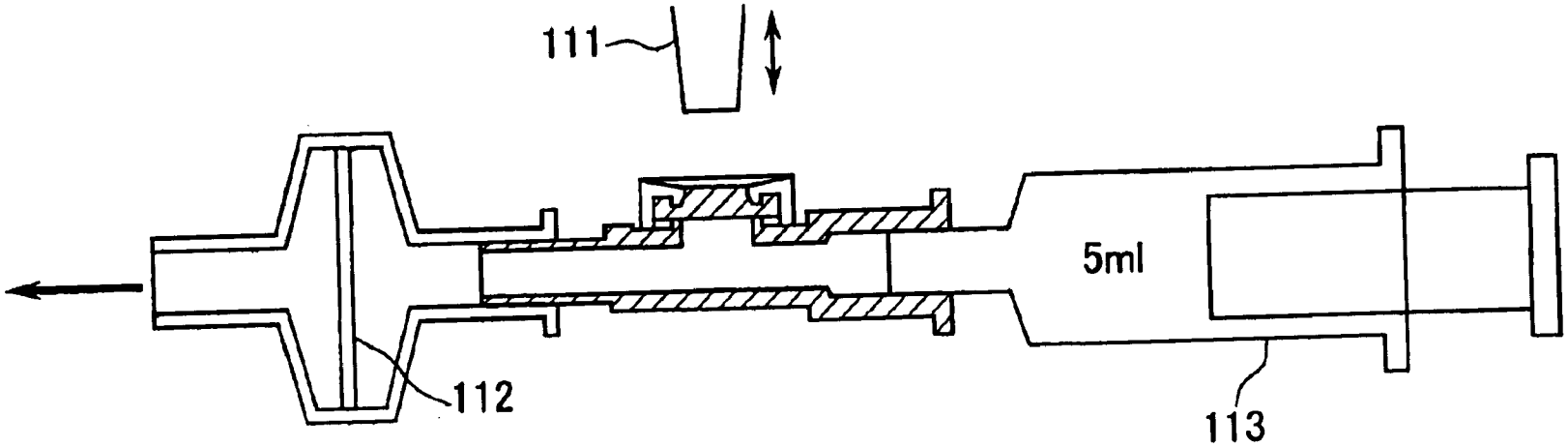
FIG. 11 is an explanatory diagram of a method for confirming the occurrence of foreign matter in regard to the medical fluid container plug body for the present invention.

For the part of the experiment concerning visible foreign matter, we prepared the test system shown in FIG. 11, including a membrane filter 112 (Millipore-made, 0.45 micron pore diameter, 13 mm diameter) in the plug body for medical fluid containers, and a syringe 113 filled with filtered water. First, the syringe 113 was filled with filtered water and then cleared of internal air bubbles. Next, the plug body for medical fluid containers was penetrated five times by an ordinary syringe luer connector 111, then, after the filtered water inside syringe 113 was further filled into the piece, the membrane filter 112 was withdrawn and examined visually for foreign matter. The results were that no foreign matter was confirmed for the film of either (1) or (2).

Figure 12:
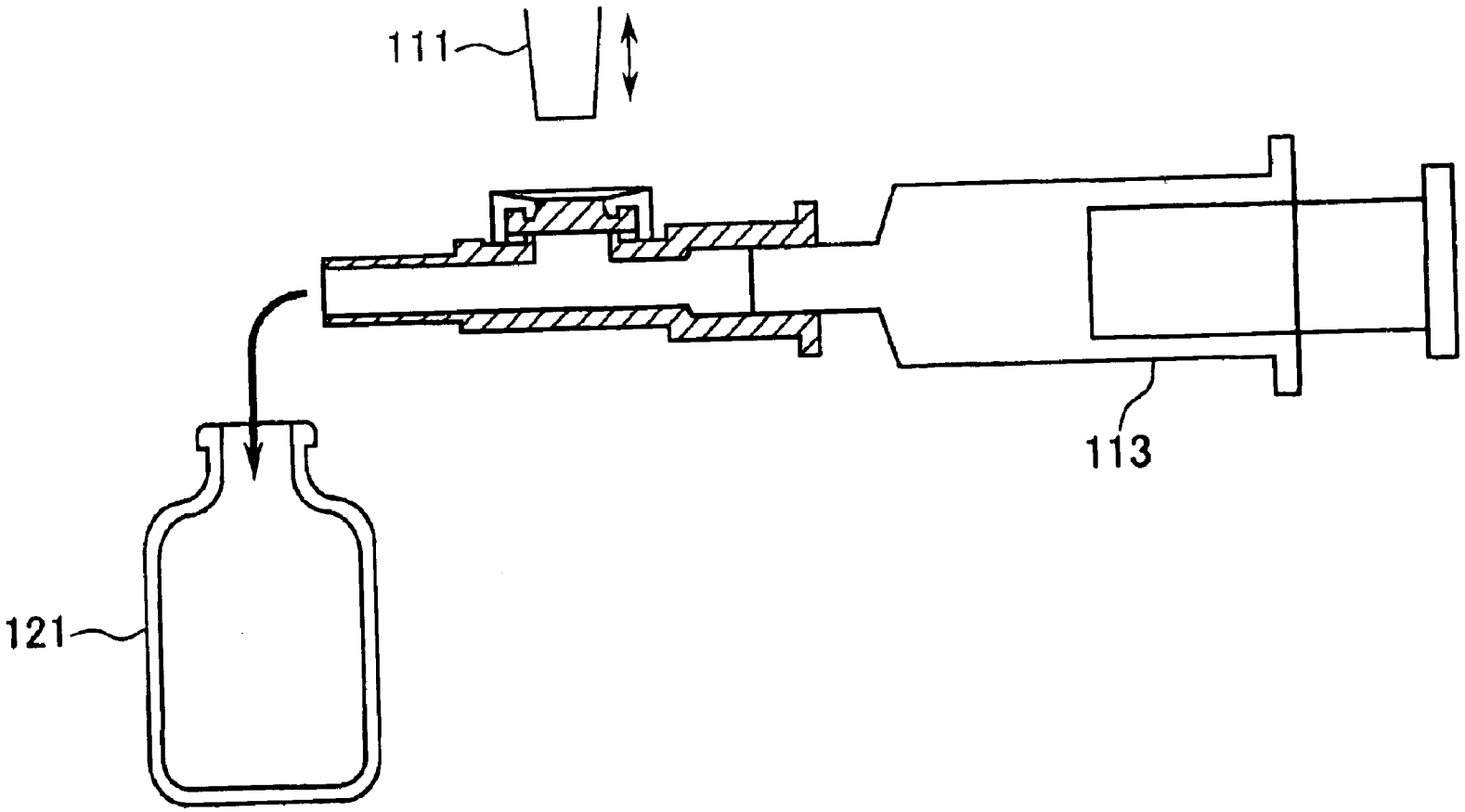
FIG. 12 is an explanatory diagram of a method for confirming the occurrence of foreign matter in regard to the medical fluid container plug body for the present invention.

In the part of the experiment concerning foreign matter that is not detectable by the human eye, as shown in FIG. 12, before inserting the syringe luer connector 111, priming was performed with filtered water inside the test system, then after clearing the test system of internal air bubbles, the system was closed. After penetrating the plug body for medical fluid containers five times with the syringe luer connector, 20 ml of filtered water inside the syringe 113 was discharged through the test system and sampled in a vial bottle 121, then the sampled filtered water was measured for foreign matter using a light-shielded type automatic particulate measurement apparatus. The results were 2.9 particulates per milliliter for foreign matter equal to or larger than 10 microns, and 0.1 particulates per milliliter for foreign matter equal to or larger than 25 microns, thereby making it evident that a sufficient standard of medical fluid quality assurance had been achieved.

INDUSTRIAL APPLICABILITY

As shown above, the plug body for medical fluid containers of the present invention is able, with its film, to prevent contact between the valve and the medical fluid, as well as enabling a reduction in the penetration resistance for the insertion of insertion bodies with obtuse tips such as those of luer connectors. Further, it is also able to prevent the medical fluid contamination that can occur when film ruptured by insertion bodies with obtuse tips falls into the medical fluids.

What is claimed is:

1. A plug body for a medical fluid container, comprising:

a disk-shaped valve provided with an insertion hole in its central portion; and a cover that fixedly supports the valve, covering at least the valve's upper periphery;

wherein a lower periphery of the valve's rear surface is supported by a pedestal portion, a film covering the rear surface of the valve is arranged on an upper surface of the pedestal portion, and the film can be pressed through by an insertion member with an obtuse tip; and wherein the film is a layered film including s film provided with a multitude of pass-through pores or slits and a film that does not include pores or slits.

2. The plug body for a medical fluid container according to claim 1, further comprising a locking means for locking the insertion member to the plug body using an outer edge of the cover, which is provided with a fitting hole, when the insertion member is inserted into the insertion hole.

3. The plug body for a medical fluid container according to claim 1, wherein a peripheral portion of the pedestal portion is beveled.

4. The plug body for medical fluid containers according to any of the claims 1, wherein the penetration resistance of the film against the obtuse tip insertion member is not more than 30 Newtons.

5. The plug body for medical fluid containers according to claim 1, wherein the film, in the event of film rupture caused by the insertion member, is ruptured linearly.

6. The plug body for medical fluid containers according to claim 1, wherein a front surface of the valve has a ring-shaped notch portion, which, upon insertion of the insertion member with an obtuse tip, causes the valve to be sectioned into a portion that is fixed and a portion that expands.

* * * * *